US011295919B2

(12) United States Patent
Askan

(10) Patent No.: US 11,295,919 B2
(45) Date of Patent: Apr. 5, 2022

(54) CIRCUIT-BREAKER WITH REDUCED BREAKDOWN VOLTAGE REQUIREMENT

(71) Applicant: Eaton Intelligent Power Limited, Dublin (IE)

(72) Inventor: Kenan Askan, Vienna (AT)

(73) Assignee: Eaton Intelligent Power Limited, Dublin (IE)

( * ) Notice: Subject to any disclaimer, the term of this patent is extended or adjusted under 35 U.S.C. 154(b) by 237 days.

(21) Appl. No.: 16/536,351

(22) Filed: Aug. 9, 2019

(65) Prior Publication Data

US 2020/0152407 A1 May 14, 2020

(30) Foreign Application Priority Data

Nov. 12, 2018 (GB) ..... 1818407

(51) Int. Cl.
*H01H 71/08* (2006.01)
*H01H 71/12* (2006.01)

(52) U.S. Cl.
CPC ..... *H01H 71/08* (2013.01); *H01H 71/123* (2013.01)

(58) Field of Classification Search
CPC ..... H01H 71/08; H01H 71/123
See application file for complete search history.

(56) References Cited

U.S. PATENT DOCUMENTS

2002/0159212 A1* 10/2002 Oughton, Jr. ..... H02H 9/041 361/111
2006/0202636 A1* 9/2006 Schneider ..... H02J 9/062 315/291
2007/0121257 A1* 5/2007 Maitra ..... H01H 9/542 361/2
2016/0203932 A1 7/2016 Niehoff
2017/0236676 A1* 8/2017 Barton ..... H02J 13/0004 361/115
2019/0206639 A1 7/2019 Askan

FOREIGN PATENT DOCUMENTS

GB 2520529 A 5/2015
WO WO 2018046709 A1 3/2018
WO WO 2018091418 A1 5/2018

* cited by examiner

*Primary Examiner* — Scott Bauer
(74) *Attorney, Agent, or Firm* — Leydig, Voit & Mayer, Ltd.

(57) ABSTRACT

A circuit-breaker includes: an input terminal for connecting the circuit-breaker to a voltage source; an output terminal for connecting t the circuit-breaker to a load; a switching circuit having an input side connected to the input terminal and having an output side; and a separation switching unit connected to the output terminal and to the output side of the switching circuit. The switching circuit includes a first current path and a second current path, the first and the second current path being connected in parallel between the input side and the output side. The switching circuit includes a varistor device and a controllable switching component, the varistor device and the controllable switching component being connected in series between the first and the second current path.

13 Claims, 10 Drawing Sheets

CIRCUIT-BREAKER WITH REDUCED BREAKDOWN VOLTAGE REQUIREMENT

CROSS-REFERENCE TO PRIOR APPLICATION

Priority is claimed to British Patent Application No. GB 1818407.7, filed on Nov. 12, 2018, the entire disclosure of which is hereby incorporated by reference herein.

FIELD

The invention is directed to a circuit-breaker with reduced breakdown voltage requirement, especially for components of a switching circuit of the circuit-breaker.

BACKGROUND

A metal oxide varistor (MOV), which is a non-linear resistor, may be used in a circuit breaker, for example a hybrid circuit breaker or a solid state circuit breaker, as an over voltage protection device. The varistor is the most critical component during the interruption of a load current, fault current and over-current. The energy stored in the line and stray inductances is transferred to the varistor. The varistor dissipates almost 99% of its energy as heat and increases its voltage to stop the current flow in the circuit-breaker.

The current-voltage (I-V) characteristics of the varistor are important to dimension and select appropriate semiconductor switches with appropriate breakdown voltages in the switching circuit of the circuit-breaker. Even at low voltages a (metal oxide) varistor can conduct a small amount of current and faces thermal run away if the energy is above the maximum allowed energy of the varistor. In order to avoid leakage current flowing through the varistor at nominal source voltages, a (metal oxide) varistor having an appropriate clamping voltage shall be selected at the maximum ambient (case) temperature.

Due to logarithmic I-V characteristics of the (metal oxide) varistor, semiconductor switches with large breakdown voltage are required. This results in dramatically increased conduction losses, size and cost of semiconductor switches.

SUMMARY

In an embodiment, the present invention provides a circuit-breaker, comprising: an input terminal configured to connect the circuit-breaker to a voltage source; an output terminal configured to connect the circuit-breaker to a load; a switching circuit having an input side connected to the input terminal and having an output side; and a separation switching unit connected to the output terminal and to the output side of the switching circuit, wherein the switching circuit comprises a first current path and a second current path, the first and the second current path being connected in parallel between the input side and the output side, and wherein the switching circuit comprises a varistor device and a controllable switching component, the varistor device and the controllable switching component being connected in series between the first and the second current path.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides a circuit-breaker having a reduced breakdown voltage requirement for semiconductor switches.

The circuit-breaker allows to decrease the breakdown voltage requirement by actively connecting and disconnecting a lower voltage clamping MOV from the protection point.

Figure 1:
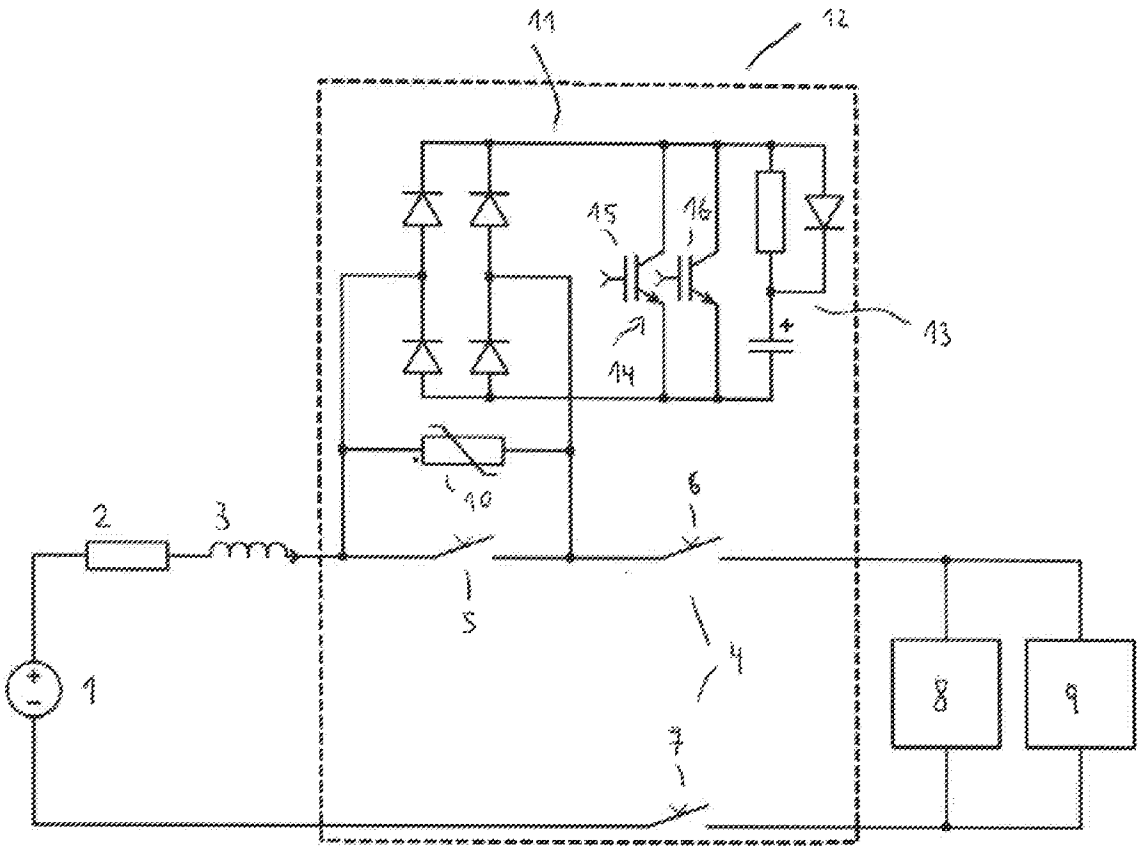
FIG 1 PRIOR ART
FIG. 1 shows a conventional embodiment of a hybrid circuit-breaker comprising a varistor as an overvoltage protection device according to US 2016/0203932 A1.

FIG. 1 shows an embodiment of a conventional circuit-breaker 12, being embodied as a hybrid circuit-breaker. A voltage source 1 is applied to the circuit breaker 12 via a resistor 2 and inductor 3. In the other figures, the voltage source is also referenced with 1 and the resistor is referenced with 2 and the inductor is referenced with 3. Furthermore, in all Figures the reference sign 9 represents a load, for example an R-L-C load, which is coupled to the circuit breaker. The reference sign 8 indicates a fault in all Figures.

Figure 2:
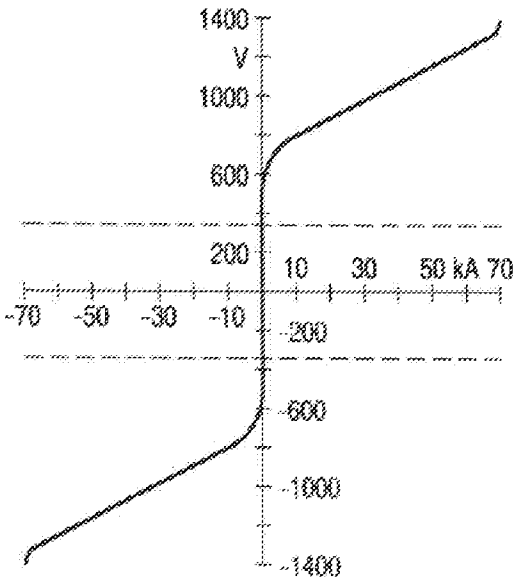
FIG 2 PRIOR ART
FIG. 2 illustrates I-V characteristics of a varistor device.
Figure 2:
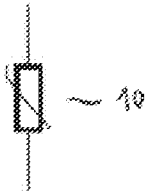
FIG 2 PRIOR ART

The circuit breaker 12 comprises a switching circuit 11. The switching circuit 11 comprises a controllable switching unit 14 including a controllable switch 15 and a controllable switch 16. The controllable switches 15 and 16 may be respectively configured as an IGBT (insulated-gate bipolar transistor) being embedded in a diode rectifier bridge in order to build up a four-quadrant bi-directional power semiconductor switch. The four-quadrant switch is placed in parallel with a bypass switch 5. The bypass switch 5 is connected in series to a separation switching unit 4 comprising separation relays 6 and 7. A varistor device 10 is connected in parallel to the switching circuit 11 and the bypass switch 5. The Varistors (variable resistors) are basically voltage-dependent resistors with a symmetrical V-I characteristic curve, as shown in FIG. 2. The resistance of a varistor decreases with increasing voltage. The varistor device 10 of the circuit-breaker 12 of FIG. 1 may be configured as a metal oxide varistor (MOV). A metal oxide varistor is a non-linear resistor which is used in the hybrid circuit-breaker of FIG. 1 as an overvoltage protection device.

Figure 3:
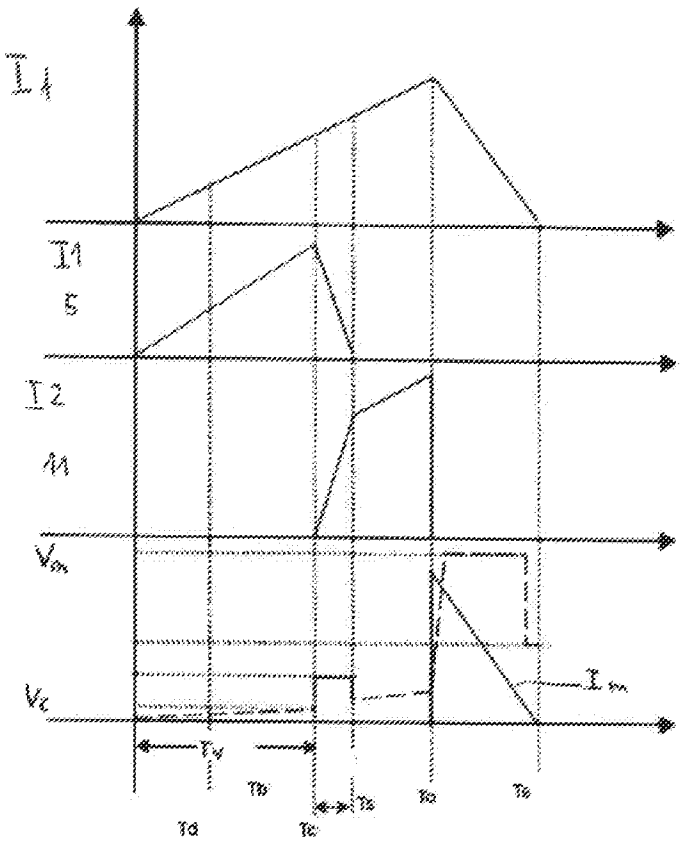
FIG 3 PRIOR ART
FIG. 3 shows current and voltage wave forms of a hybrid circuit-breaker during the interruption of a prospective short-circuit current.

FIG. 3 shows a diagram of current and voltage wave forms of a circuit-breaker being embodied as a hybrid circuit-breaker, as shown in FIG. 1, during the interruption of a 10 kA prospective short-circuit current. The three upper diagrams illustrate the source current If generated by the voltage source 1, the current I1 through the bypass switch 5, and the current I2 flowing through the switching circuit 11. The lower diagram shows the voltage Vc/Vm at the contacts of the bypass switch 5/the varistor device 10 and the current Im through the varistor device 10.

As soon as a fault has been detected at time $T_d$, the bypass switch 5 is triggered to open its contact. The mechanical contacts of the bypass switch 5 start to open at $T_b$ due to electro-mechanical delays ($T_v$). At $T_b$, with first contact movement of the bypass switch 5, an arc voltage is produced between the contacts to force the fault current to commutate to the switching circuit 11. Next, at $T_s$, the complete fault current flows through the switching circuit 11. At $T_o$, the controllable switches 15 and 16 are turned off, thus causing the current to commutate to an RCD (Resistor-Capacitor-Diode) snubber network 13 and the metal oxide varistor device 10. The network 13 is used to bypass the delay time in response of the varistor device 10. At $T_e$, the fault current has almost reached a zero level, and the separation switches 6 and 7 can be opened without current and voltage being applied to the contacts.

Figure 4:
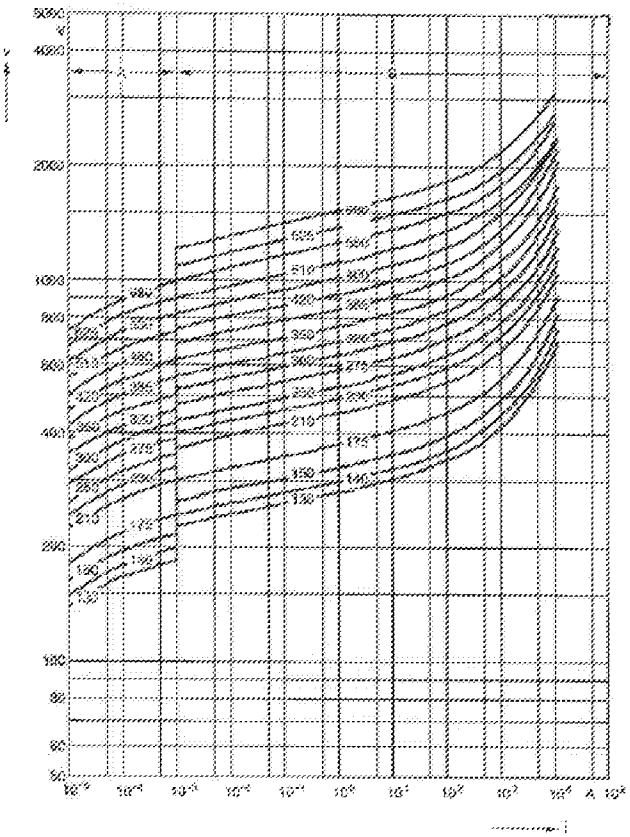
FIG 4 PRIOR ART
FIG. 4 shows current-voltage characteristics of a standard varistor.

The current-voltage (I-V) characteristics of the varistor device 10 are important to dimension and select appropriate controllable switches/semiconductor switches 15 and 16 with appropriate breakdown voltages. FIG. 4 illustrates current-voltage characteristics from a standard varistor, for example S20K300E3K1 at maximum temperature of 85° and with minimum and maximum tolerances from EPCOS.

Referring to FIG. 3, in this example a varistor, for example S20K300E3K1 from EPCOS, having AC300Vrms and DC385 V withstands voltage at 85° C. case temperature where the leakage current is smaller than 1 mA in steady state. In the example, the varistor used is a metal oxide varistor. This voltage level is suitable for 230 Vrms and 385 V nominal source voltage levels at 85°. In the case when the separation switches 6 and 7, for example galvanic separation relays, are not open, the varistor device 10 arranged parallel to the bypass switch 5 will continuously, or at least until the opening of the separation relays 6 and 7 (standard relays open between 20 milliseconds to 30 milliseconds), face the source voltage. At the turnoff of the fault current around 1650 A, the voltage peak on the controllable switches 15 and 16 is around 1000 V for a short time, for instance a few hundred microseconds. This is to say that the controllable switches 15 and 16, for example, the IGBTs, shall have at least 1200 V breakdown voltage at 25° C. junction temperature.

With the presumption that the separation switches/galvanic separation relays 6 and 7 will be always switched off during the switch-off operation of the complete breaker, a lower voltage clamping varistor could be used to decrease the voltage peak during the turn-off of the controllable switches 15 and 16 and reduce the breakdown voltage requirements of the controllable switches 15 and 16 and diodes in the rectifier bridge. As shown in FIG. 4, the varistor device S20K150300EK1 from EPCOS can operate at AC 150 Vrms and DC 200 V at 85° C. case temperature while the leakage current is less than 1 mA. This varistor would keep the peak voltage below 600 V DC during turning-off 1650 A fault current. This is to say that 600/650 V IGBT could be used as a controllable switch instead of 1200 V IGBT. In this application, the 600/650 V IGBT used as controllable switches 15 and 16 and the diodes in the rectifier bridge would result in a reduced semiconductor active area, cost and on-state losses as drift region decreases with a decreased breakdown voltage.

Nevertheless, at 350 V DC there would be around a few 10 Amps flowing through the varistor of the S20K150300EK1 type. That means that even at low voltages the varistor device can conduct a small amount of current and faces thermal run-away if the energy is above the maximum allowed energy of the varistor device. The separation switches 6 and 7, for example the galvanic separation relays, could react and open the contacts under current. As the galvanic separation relays are not ultra-fast contact openings like the bypass relay 5 and have 20 ms to 30 ms conventional opening time, the dissipated fault energy and the additional few Amps flowing through the varistor device 10 may result in thermal run-away of the device.

In addition, the separation switches 6 and 7 would need to be able to open the contact at 10 A DC current which may not be possible or may be difficult due to DC operation and no arc-extinguishing characteristics of the bypass-relays. In a state of the art hybrid circuit-breaker according to US 2016/0203932 A1, the bypass relays are sized to open contact under no current and to provide galvanic separation only.

It is also a known fact from US 2016/0203932 A1 that at closing of the galvanic separation relays, even the bypass relay 5 and the controllable switches 15, 16 are in the off-position, there will be a huge inrush current flowing through the bouncing contacts. This results in damaged contacts under repeated arcing during the bouncing which may last for a few milliseconds.

Figure 5:
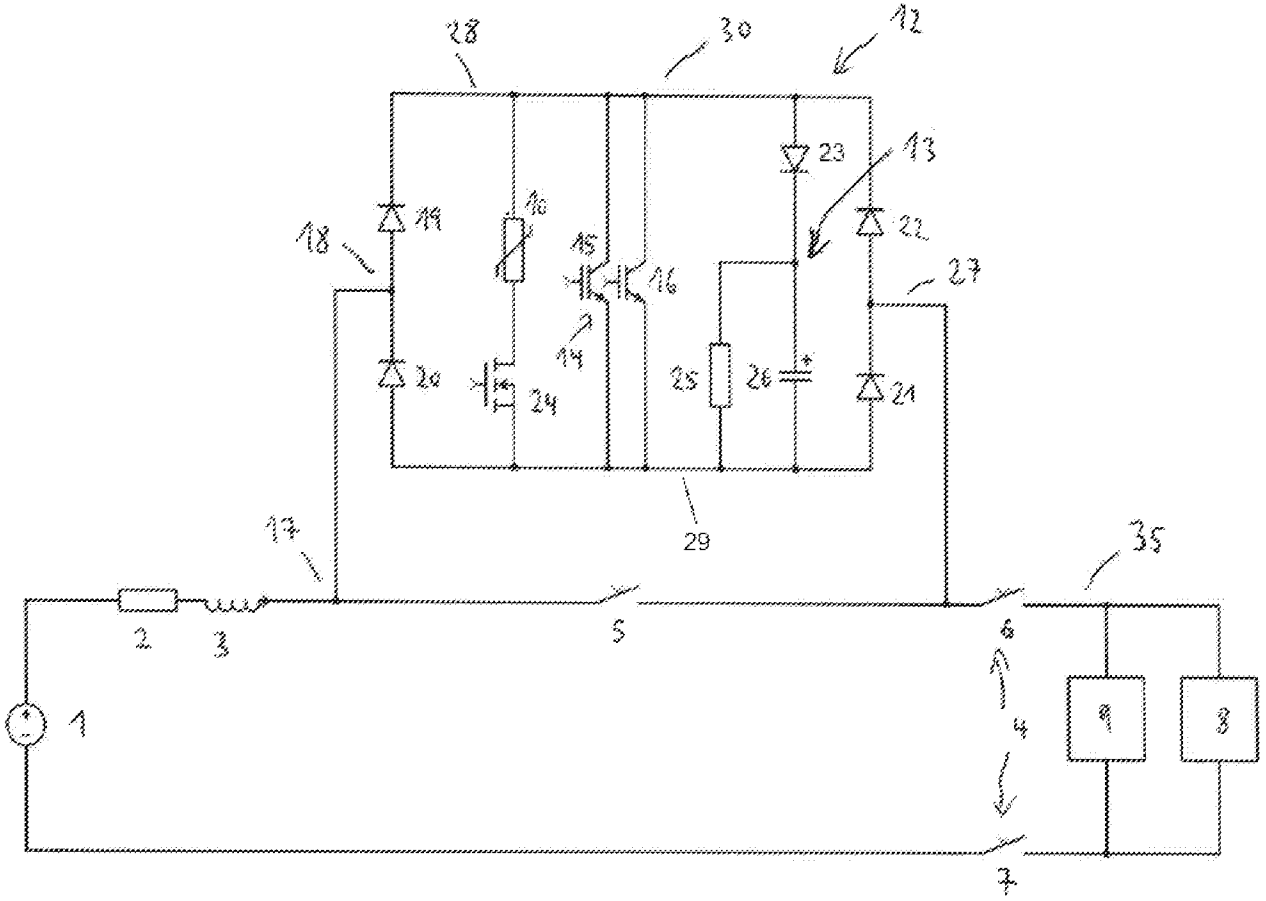
FIG. 5 illustrates a first embodiment of a circuit-breaker with reduced breakdown voltage requirement of controllable switches of a controllable switching unit of the circuit-breaker.

FIG. 5 shows an embodiment of a circuit-breaker 12 with reduced breakdown voltage requirement comprising an input terminal 17 to connect the circuit-breaker 12 to a voltage source 1, and an output terminal 35 to connect the circuit-breaker 12 to a load. In the illustrated embodiment, the load RLC consisting of resistance, inductance and capacitance is short-circuited by a fault. The circuit-breaker 12 comprises a switching circuit 30 having an input side 18 being connected to the input terminal 17 of the circuit-breaker and having an output side 27. The circuit-breaker 12 further comprises a separation switching unit 4 being connected to the output terminal 35 and to the output side 27 of the switching circuit 30. The switching circuit 30 comprises a first current path 28 and a second current path 29. The first and the second current path 28, 29 are connected in parallel between the input side 18 and the output side 27 of the switching circuit. The switching circuit 30 comprises a varistor device 10 and a controllable switching component 24 which are connected in series between the first and the second current path 28, 29.

The switching circuit 30 comprises a controllable switching unit 14/DC link being arranged between the first and the second current path 28, 29 to short-circuit the first and the second current path 28, 29. The controllable switching unit 14 comprises at least one controllable switch being connected to the first current path 28 and the second current path 29. In particular, according to the embodiment of the circuit-breaker shown in FIG. 5, the controllable switching unit 14 comprises at least a first controllable switch 15 or several controllable switches. FIG. 5 shows an embodiment of the controllable switching unit 14 comprising a first controllable switch 15 and a second controllable switch 16 being connected in parallel between the first current path 28 and the second current path 29. The at least one controllable switch 15, 16 are respectively embodied as an insulated-gate bipolar transistor (IGBT) or a MOSFET or similar switches.

According to the embodiment of the circuit-breaker 12 shown in FIG. 5, the circuit-breaker comprises a first diode 19, a second diode 20, a third diode 21 and a fourth diode 22. The first diode 19 is connected to the input side 18 of the switching circuit 30 and the first current path 28. The second diode 20 is connected to the input side 18 of the switching circuit 30 and the second current path 29. The third diode 21 is connected to the output side 27 of the switching circuit 30 and the first current path 28. The fourth diode 22 is connected to the output side 27 of the switching circuit 30 and the second current path 29.

According to the embodiment shown in FIG. 5, the circuit-breaker 12 comprises a (turn-off snubber) network 13 including a fifth diode 23, a first resistor 25 and a capacitor 26. The fifth diode 23 is connected to the first current path 28. The first resistor 25 and the capacitor 26 are configured as a parallel connection being connected between the fifth diode 23 and the second current path 29.

The circuit-breaker 12 comprises a bypass switch 5 being connected to the input terminal 17 and the output side 27 of the switching circuit 30. The bypass switch 5 is connected in parallel to the switching circuit 30.

The circuit-breaker 12 shown in FIG. 5 solves the problems which are given above, by introducing the controllable switching component 24, in particular a unidirectional semiconductor switch, in series with the varistor device 10 which is integrated into the DC link of the solid state four-quadrant bi-directional power electronics switch. The circuit-breaker 12 makes it possible that utilization of controllable switches 15, 16 and diodes 19, . . . , 23 having a lower breakdown voltage requirement is possible.

As shown in FIG. 5, the controllable switching component 24 may be configured as a semiconductor switch being connected in series with the varistor device 10. The controllable switching component 24 is used to turn off the varistor device leakage currents in order to open the separation switches/galvanic separation relays 6 and 7 without current to avoid overheating of the varistor device and to be able to open the separation switches 6 and 7 without arcing. The controllable switching component 24 may be configured as a MOSFET or an IGBT or a conventional turned-on JFET. The controllable switching component 24 will be turned on only during switch on and off operations of the breaker. By this realization, it is possible to use IGBTs 15 and 16 having a breakdown voltage of 600 V instead of using IGBTs 15 and 16 having a breakdown voltage of 1200 V.

Figure 6:
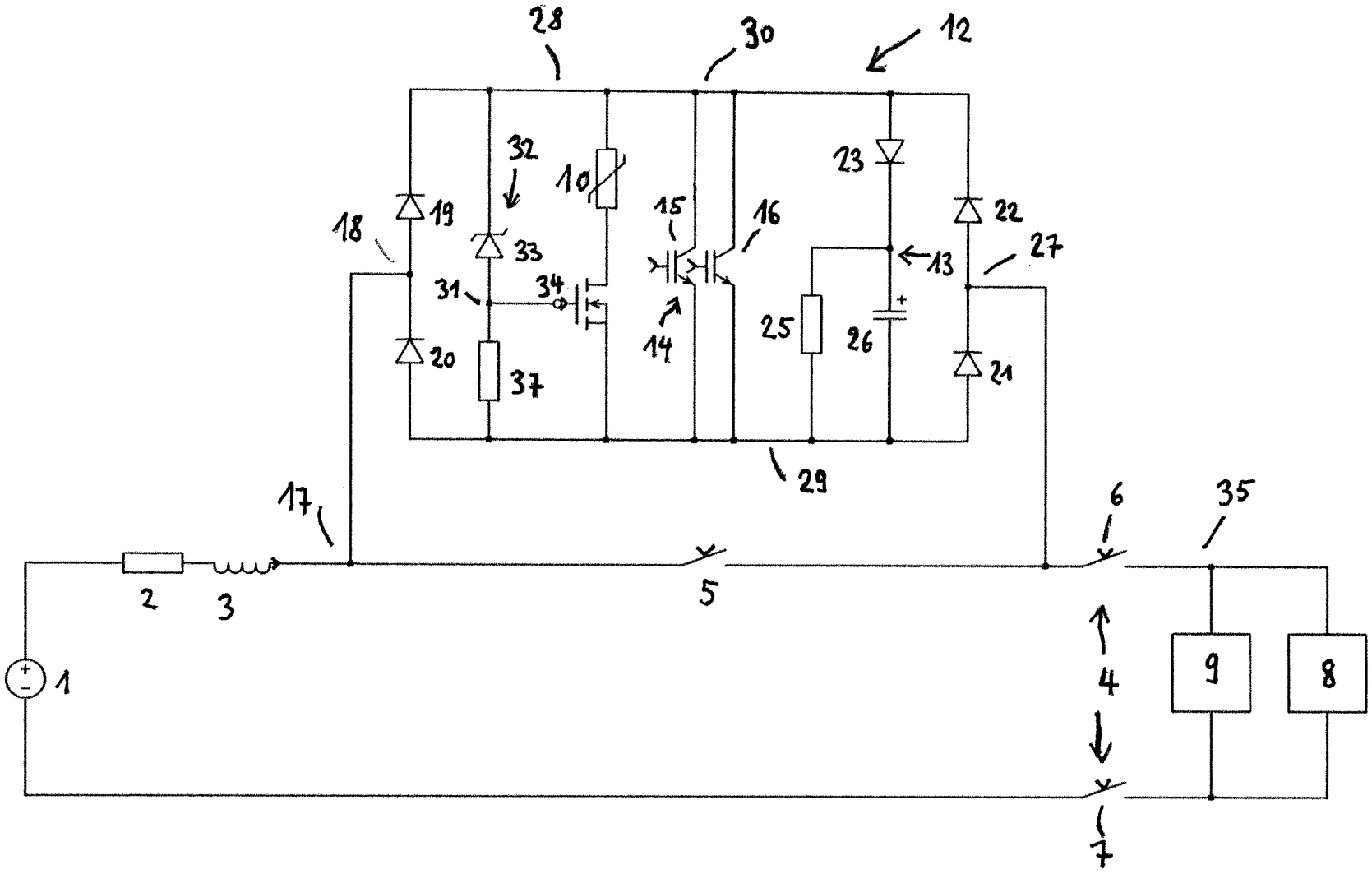
FIG. 6 shows a second embodiment of a circuit-breaker with reduced breakdown voltage requirement of controllable switches of a controllable switching unit of the circuit-breaker.

FIG. 6 shows another embodiment of a circuit-breaker 12 with reduced breakdown voltage requirement for the controllable switches 15 and 16 of the controllable switching unit 14. In addition to the embodiment of the circuit-breaker 12 shown in FIG. 5, the circuit-breaker 12 of FIG. 6 comprises a control circuit 32 to control the controllable switching component 24. The control circuit 32 comprises a Zener diode 33 and a second resistor 37. The Zener diode 33 and the second resistor 37 are connected in series between the first current path 28 and the second current path 29. A control connection 34 of the controllable switching component 24 is connected to an internal node 31 of the control circuit 32 between the Zener diode 33 and the second resistor 37. The Zener diode 33 in series with the second resistor 37 is used to switch on and off the controllable switching component 24 without additional gate driver and power source.

Figure 7:
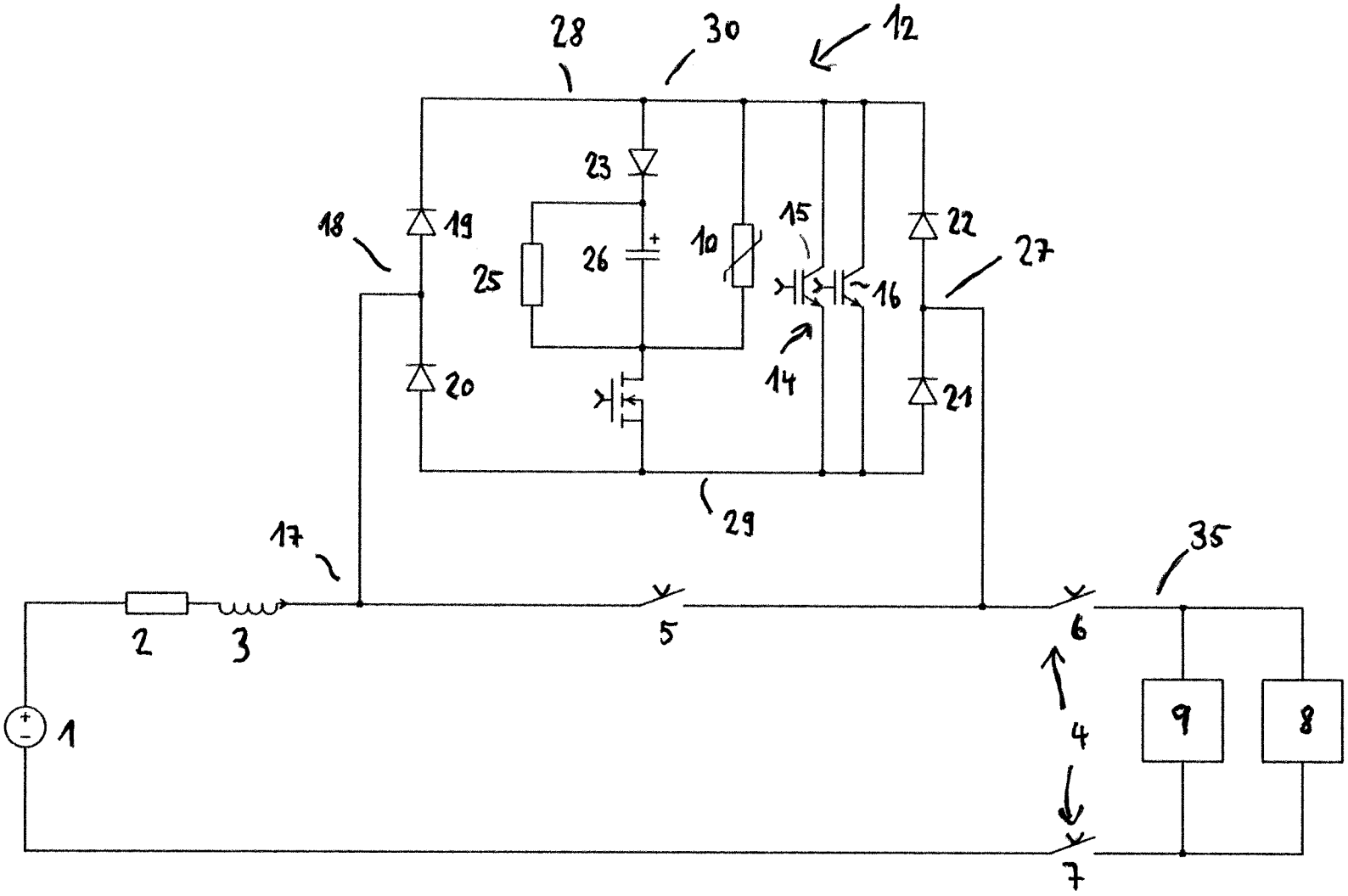
FIG. 7 shows a third embodiment of a circuit-breaker with reduced breakdown voltage requirement of controllable switches of a controllable switching unit of the circuit-breaker.

FIG. 7 shows an embodiment of a circuit-breaker 12 to avoid arc generation during bouncing of the separation switches 6 and 7 during normal switch-on due to an inrush current of the capacitor 26 of the (snubber) network 13 of FIG. 5. The network 13 is basically used as an overvoltage protection to protect the controllable switching unit 14 and to bypass the delay time in response to the varistor device 10. The network 13 includes a fifth diode 23, a first resistor 25 and a capacitor 26. The fifth diode 23 is connected to the first current path 28. The first resistor 25 and the capacitor 26 are configured as a parallel connection. The parallel connection of the first resistor 25 and the capacitor 26 is connected between the fifth diode 23 and the controllable switching component 24.

This configuration allows to eliminate the arcing during the bouncing of the separation switches 6 and 7 due to the (snubber) capacitor 26. Nevertheless, by good connection of the leads of the varistor device 10 with the shortest possible length, it may be possible to remove the (snubber) network 13 from the circuit. This is because the varistor device 10 has a very short response time such as a few 10 ns.

The effects of cosmic rays on the switching circuit 30 of the circuit-breaker which is facing its source voltage constantly may be an issue. Nevertheless, by switching off the separation switches/galvanic separation relays 6 and 7 by a switch-off operation of the breaker, the separation switches 6 and 7 will not face continuous source voltage applied to them. Such as for 100.000 switching cycles under source voltage and current, the controllable switching unit 14 will face only less than a total of one hour in its complete lifetime.

Figure 8:
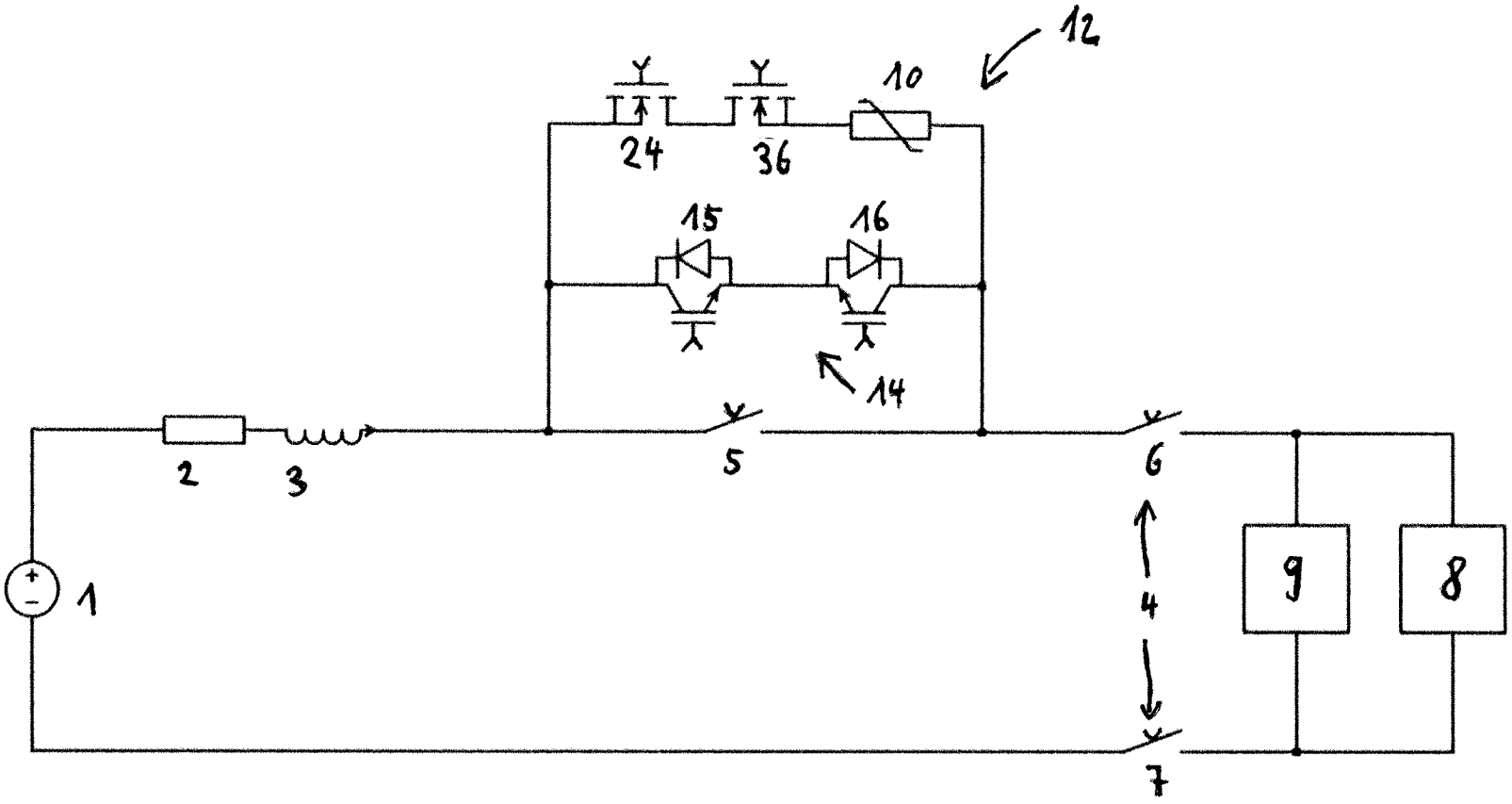
FIG. 8 illustrates an embodiment of a circuit-breaker with reduced breakdown voltage requirement of back-to-back connected controllable switches of a controllable switching unit of the circuit-breaker.

FIG. 8 shows another embodiment of a circuit-breaker 12 in a back-to-back topology having controllable switches 15 and 16, for example IGBTs, with freewheeling antiparallel diodes or MOSFETs in anti-series position.

Figure 9:
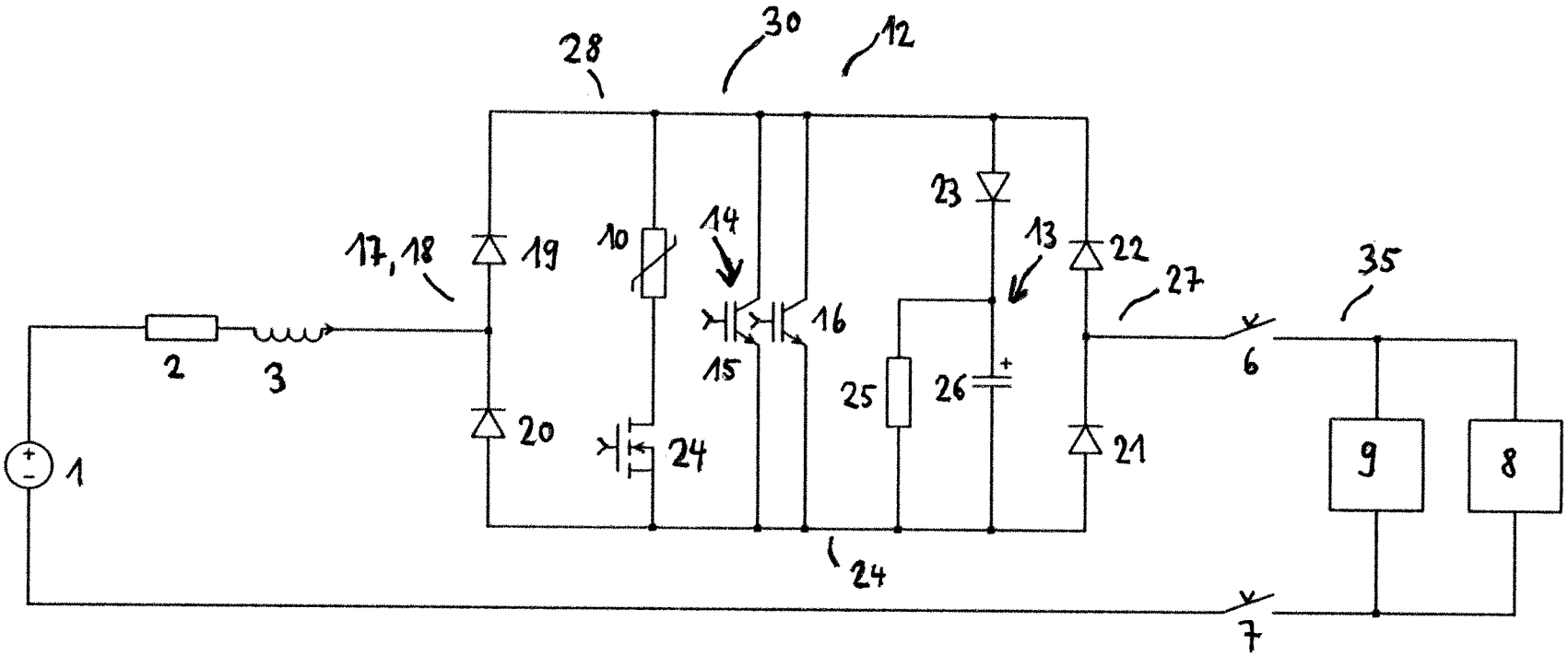
FIG. 9 shows an embodiment of a circuit-breaker being configured as a solid state circuit-breaker with reduced breakdown voltage requirement of controllable switches of a controllable switching unit of the circuit-breaker.
Figure 10:
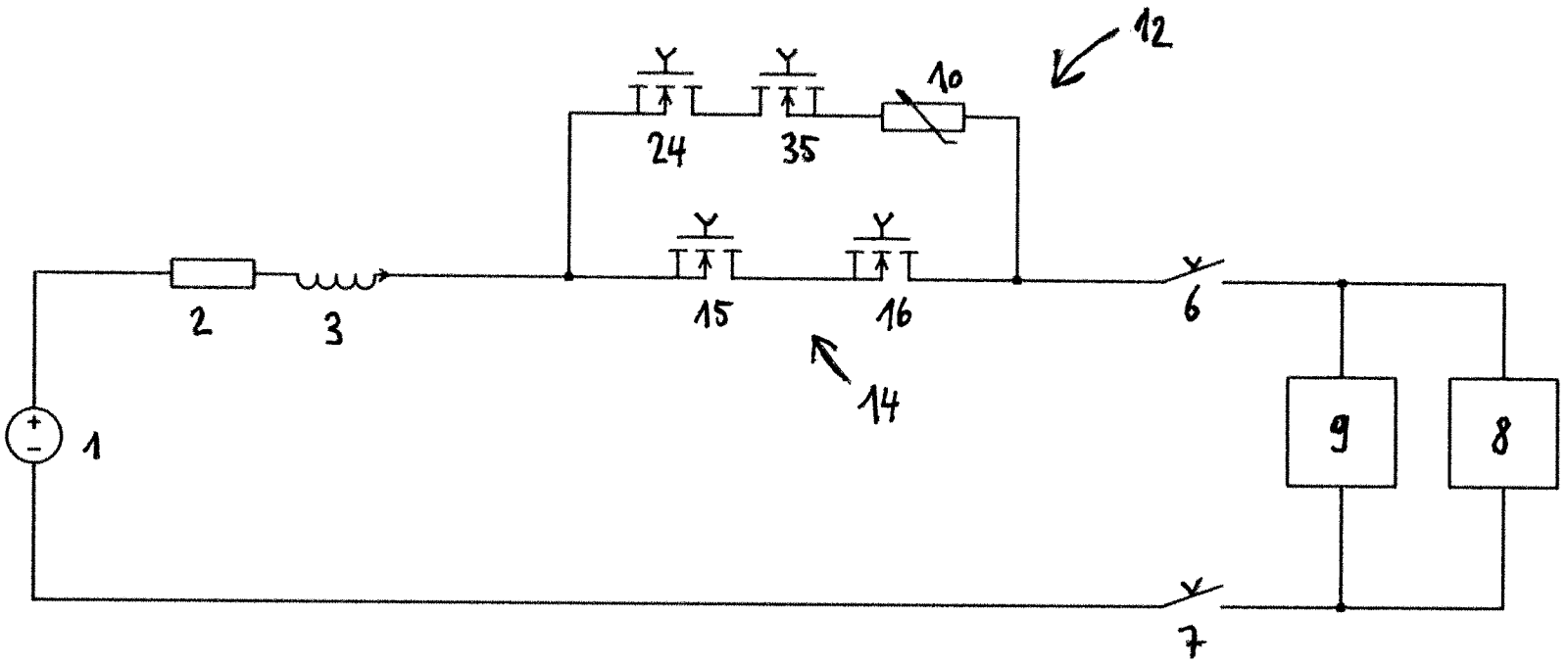
FIG. 10 illustrates an embodiment of a solid state circuit-breaker in a back-to-back topology with reduced breakdown voltage requirement of controllable switches of a controllable switching unit.

FIGS. 5 to 8 show various embodiments of a circuit-breaker 12 being respectively embodied as a hybrid circuit-breaker. The invention can be further used in a solid state circuit-breaker where the breaker faces high solid state ohmic losses, as shown in FIG. 9 and FIG. 10. The invention used in a solid state circuit-breaker configuration reduces the solid state ohmic power losses of the circuit-breaker by half.

According to the embodiment of the solid state circuit-breaker shown in FIG. 9, the bypass switch 5 of the circuit-breakers of FIGS. 5 to 8 is removed so that it is only the switching circuit 30 which is connected between the input terminal 17 of the circuit-breaker and the separation switching unit 4.

FIG. 10 shows an embodiment of the solid state circuit-breaker in a back-to-back topology. The switching circuit 30 comprises a first branch with controllable switching components 15 and 16 in anti-series position connected in series to the varistor device V, and a second branch including controllable switches 24, 36, for example MOSFETs or IGBTs.

In conclusion, the circuit-breaker of the invention essentially provides two solutions. First, by utilization of a controllable switching component 24 in series with the varistor device 10 in controllable switches/IGBTs embedded in a diode rectifier, it is possible to decrease the breakdown voltage requirement of the controllable switches/IGBTs, diodes or MOSFETs by half by a varistor clamping voltage decreased by half.

PN-diodes and IGBTs are minority carrier semiconductor switches (bipolar) and their on-state voltage drop is proportional to the breakdown voltage. MOSFETs and Schottky diodes are majority carrier semiconductor switches (unipolar) and their on-state voltage drop is proportional to the square of the breakdown voltage. In other words, the conduction losses of the semiconductor switches can be halved as well by dramatically reduced on-state channel resistance. By decreasing the breakdown voltage requirement of the semiconductor switches, a hybrid circuit-breaker with larger current density can be realized.

Secondly, the circuit-breaker of the present invention also avoids the arcing during the closing of separation switches 6 and 7 under bouncing due to the (snubber) capacitor 26 of the network 13.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A circuit-breaker, the circuit-breaker comprising:

an input terminal configured to connect the circuit-breaker to a voltage source;

an output terminal configured to connect the circuit-breaker to a load;

a switching circuit having an input side connected to the input terminal and having an output side;

a separation switching unit connected to the output terminal and to the output side of the switching circuit, the separation switching unit comprising separation relays configured to disconnect the load;

a first diode;

a second diode;

a third diode;

a fourth diode; and a network including a fifth diode, a first resistor, and a capacitor, wherein the switching circuit comprises a first current path and a second current path, the first and the second current path being connected in parallel between the input side and the output side, wherein the switching circuit comprises a varistor device and a controllable switching component, the varistor device and the controllable switching component being connected in series between the first current path and the second current path, wherein the first diode is connected to the input side of the switching circuit and the first current path, wherein the second diode is connected to the input side of the switching circuit and the second current path, wherein the third diode is connected to the output side of the switching circuit and the first current path, wherein the fourth diode is connected to the output side of the switching circuit and the second current path, wherein the fifth diode is connected to the first current path, wherein the first resistor and the capacitor are configured as a parallel connection, wherein the fifth diode, the parallel connection of the first resistor and the capacitor, and the controllable switching component are connected in series between the first current path and the second current path, and wherein the parallel connection of the first resistor and the capacitor is connected between the fifth diode and the controllable switching component.

2. The circuit-breaker of claim 1, wherein the switching circuit comprises a controllable switching unit arranged between the first and the second current path so as to be configured to short-circuit the first and the second current path.

3. The circuit-breaker of claim 2, wherein the controllable switching unit comprises at least one controllable switch connected to the first current path and the second current path.

4. The circuit-breaker of claim 3, wherein the at least one controllable switch comprises a first controllable switch and a second controllable switch connected in parallel between the first current path and the second current path.

5. The circuit-breaker of claim 4, wherein the first and the second controllable switches each respectively comprise an insulated-gate bipolar transistor.

6. The circuit-breaker of claim 1, further comprising:

a control circuit configured to control the controllable switching component, wherein the control circuit comprises a Zener diode and a second resistor, wherein the Zener diode and the second resistor are connected in series between the first current path and the second current path, and wherein a control connection of the controllable switching component is connected to an internal node of the control circuit between the Zener diode and the second resistor.

7. The circuit-breaker of claim 1, further comprising:

a bypass switch connected to the input terminal and the output side of the switching circuit, wherein the bypass switch is connected in parallel to the switching circuit.

8. The circuit-breaker of claim 1, wherein the circuit-breaker comprises a hybrid circuit-breaker.

9. The circuit-breaker of claim 1, wherein the circuit breaker comprises a solid-state circuit breaker.

10. The circuit-breaker of claim 1, wherein the network is configured as a snubber circuit and is coupled to a drain of the controllable switch at a same terminal as the varistor device.

11. The circuit-breaker of claim 1, wherein the network is connected in parallel to the varistor device.

12. The circuit-breaker of claim 1, wherein the varistor device comprises a metal oxide varistor.

13. The circuit-breaker of claim 1, wherein the controllable switching component comprises a unidirectional semiconductor switch.

* * * * *